US010214024B2

(12) United States Patent
Takanashi et al.

(10) Patent No.: US 10,214,024 B2
(45) Date of Patent: Feb. 26, 2019

(54) LIQUID EJECTING APPARATUS

(71) Applicant: SEIKO EPSON CORPORATION, Tokyo (JP)

(72) Inventors: Hiromichi Takanashi, Shiojiri (JP); Masaru Kumagai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/446,029

(22) Filed: Mar. 1, 2017

(65) Prior Publication Data

US 2017/0253038 A1 Sep. 7, 2017

(30) Foreign Application Priority Data

Mar. 4, 2016 (JP) ..... 2016-042170

(51) Int. Cl.
*B41J 2/19* (2006.01)
*B41J 2/175* (2006.01)
*B41J 2/165* (2006.01)

(52) U.S. Cl.
CPC ..... *B41J 2/19* (2013.01); *B41J 2/175* (2013.01); *B41J 2/17556* (2013.01); *B41J 2/17596* (2013.01); *B41J 2/165* (2013.01); *B41J 2002/17516* (2013.01); *B41J 2202/07* (2013.01)

(58) Field of Classification Search
CPC ..... B41J 2/19; B41J 2/17556; B41J 2/17596; B41J 2/175; B41J 2002/17516; B41J 2202/07
See application file for complete search history.

(56) References Cited

U.S. PATENT DOCUMENTS

2010/0045757 A1* 2/2010 Ito ..... B41J 2/17556 347/92

FOREIGN PATENT DOCUMENTS

JP 2009-262478 A 11/2009
JP 2012-116144 A 6/2012

* cited by examiner

*Primary Examiner* — Geoffrey S Mruk
(74) *Attorney, Agent, or Firm* — Workman Nydegger

(57) ABSTRACT

A liquid ejecting apparatus includes: a liquid ejecting head having a nozzle that ejects liquid; a supply flow path that supplies the liquid to the liquid ejecting head; a pressurizing mechanism that pressurizes a region which communicates with the supply flow path; a decompression mechanism that decompresses the region pressurized by the pressurizing mechanism; and a resistor section that interferes with decompression by the decompression mechanism.

20 Claims, 4 Drawing Sheets

LIQUID EJECTING APPARATUS

BACKGROUND

1. Technical Field

The present invention relates to a liquid ejecting apparatus such as a printer.

2. Related Art

Ink jet printers, which are one example of liquid ejecting apparatuses, are configured to perform pressurization cleaning in order to remove foreign substances such as air bubbles from a head that ejects ink. The pressurization cleaning is an operation to discharge ink from nozzles by applying pressure inside the ink supply flow path by driving a pump in a forward rotation direction. In these printers, after the pressurization cleaning is performed, the pump is driven in a reverse rotation direction to decompress the supply flow path to the original pressure. JP-A-2009-262478 is an example of related art.

When the supply flow path is decompressed, sudden decrease in pressure may cause entrainment of air bubbles or the like from the nozzle, leading to a risk of ejection error. Accordingly, the aforementioned printer is configured to measure the pressure during decompression or adjust the driving period of the pump. However, since control of such fine pressure adjustment is complicated, there is a problem that the adjustment may fail depending on a flow path condition or the like.

Such a problem is not limited to printers that perform printing by ejecting ink. In general, the same problem may occur in liquid ejecting apparatuses configured to pressurize or decompress a flow path that supplies liquid to the nozzles that eject liquid.

SUMMARY

An advantage of some aspects of the invention is that a liquid ejecting apparatus configured to reduce sudden reduction in pressure in a pressurized region is provided.

The following describes means for solving the above problem and the advantageous effect thereof.

A liquid ejecting apparatus for solving the above problem includes a liquid ejecting head having a nozzle that ejects liquid; a supply flow path that supplies the liquid to the liquid ejecting head; a pressurizing mechanism that pressurizes a region which communicates with the supply flow path; a decompression mechanism that decompresses the region pressurized by the pressurizing mechanism; and a resistor section that interferes with decompression by the decompression mechanism.

With this configuration, sudden decompression of the pressurized region can be reduced since the resistor section interferes with decompression by the decompression mechanism.

The above liquid ejecting apparatus further includes: a liquid storage chamber that forms the region; a pressurization flow path that communicates with the pressurizing mechanism and the liquid storage chamber; and a decompression flow path that communicates with the decompression mechanism and the liquid storage chamber, wherein the resistor section is provided in the decompression flow path.

With this configuration, complexity in the apparatus and control can be reduced since sudden decompression can be reduced by the flow path structure by providing the resistor section in the decompression flow path that communicates with the liquid storage chamber.

The above liquid ejecting apparatus further includes: a liquid storage chamber having a flexibly deformable displacement section on a portion of a wall and forms the region; a pressure adjustment chamber that is separated from the liquid storage chamber via the displacement section; a pressurization flow path that communicates with the pressurizing mechanism and the pressure adjustment chamber; and a decompression flow path that communicates with the decompression mechanism and the pressure adjustment chamber, wherein the resistor section is provided in the decompression flow path.

With this configuration, the region formed by the liquid storage chamber can be pressurized by pressurizing the pressure adjustment chamber via the pressurization flow path that communicates with the pressurizing mechanism so as to displace the displacement section toward the liquid storage chamber. Further, the pressurized liquid storage chamber can be decompressed by decompressing the pressure adjustment chamber via the decompression flow path that communicates with the decompression mechanism so as to displace the displacement section toward the pressure adjustment chamber. Moreover, complexity in the apparatus and control can be reduced since sudden decompression can be reduced by the flow path structure by providing the resistor section in the decompression flow path that communicates with the pressure adjustment chamber.

The above liquid ejecting apparatus further includes: a common flow path that serves as the pressurization flow path and the decompression flow path, wherein the resistor section is provided in the decompression flow path which is not the common flow path.

With this configuration, when the resistor section is provided in the common flow path that serves as a decompression flow path and a pressurization flow path, a pressurization rate during pressurization by the pressurizing mechanism is lowered. However, since the resistor section is provided in the decompression flow path which does not serve as a pressurization flow path, the decompression rate can be slowed down without reducing the pressurization rate.

The above liquid ejecting apparatus liquid ejecting apparatus further includes: a one-way valve provided in the pressurization flow path which is not the common flow path, wherein, when a location where the pressurizing mechanism is located is defined as an upstream side in the pressurization flow path, the one-way valve permits a fluid flowing from the pressurizing mechanism to a downstream side and prevents a fluid flowing from a downstream side toward the pressurizing mechanism.

With this configuration, since the one-way valve is provided in the pressurization flow path which is not the common flow path, a flow of fluid flowing from the common flow path to the pressurization flow path during decompression is reduced so as to flow the fluid into the decompression flow path. Accordingly, the decompression rate can be slowed down by effectively operating the resistor section.

The above liquid ejecting apparatus further includes: a common flow path that serves as the pressurization flow path and the decompression flow path, wherein the resistor section is provided in the common flow path.

With this configuration, the configuration of the flow path can be simplified by providing the common flow path which serves as a pressurization flow path and a decompression flow path, and providing the resistor section in the common flow path.

In the above liquid ejecting apparatus, the pressurizing mechanism is a pump that pressurizes a fluid and feeds out the pressurized fluid.

With this configuration, since the pressurizing mechanism is formed by a pump that pressurizes and pumps out a fluid, pressurization can be performed by feeding out a fluid and decompression can be performed by allowing the fluid to flow out from the space in which pressurization is performed.

In the above liquid ejecting apparatus, the pressurizing mechanism and the decompression mechanism are composed of a single pump, serve as the pressurizing mechanism when the pump flows a fluid in one direction, and serve as the decompression mechanism when the pump flows a fluid in a direction opposite to the one direction.

With this configuration, the configuration to perform pressurization and decompression can be simplified since the pump serves as a pressurizing mechanism and a decompression mechanism.

In the above liquid ejecting apparatus, the pressurizing mechanism is a pump that pressurizes gas and feeds out the pressurized gas, and the decompression mechanism is composed of an air release valve.

With this configuration, since the pressurizing mechanism is formed by a pump that pressurizes and pumps out a gas, pressurization can be performed by pumping out a gas and decompression can be performed by releasing the space in which pressurization is performed to the atmosphere by the air release valve which is the decompression mechanism to thereby decompress the space to the atmospheric pressure.

In the above liquid ejecting apparatus, the resistor section is provided in a flow path that communicates with the decompression mechanism so as to decrease a flow path cross sectional area of a portion of the flow path to be smaller than a cross sectional area of other portions to thereby interfere with decompression by the decompression mechanism.

With this configuration, decompression rate can be reduced with a simple configuration since the resistor section is provided in the flow path that communicates with the decompression mechanism so as to decrease the flow path cross sectional area of a portion of the flow path to be smaller than that of other portions to thereby interfere with decompression by the decompression mechanism.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the drawings, an embodiment of a liquid ejecting apparatus will be described. The liquid ejecting apparatus is an ink jet printer that performs recording (printing) by ejecting ink which is an example of liquid onto a medium such as a paper sheet.

First Embodiment

Figure 1:
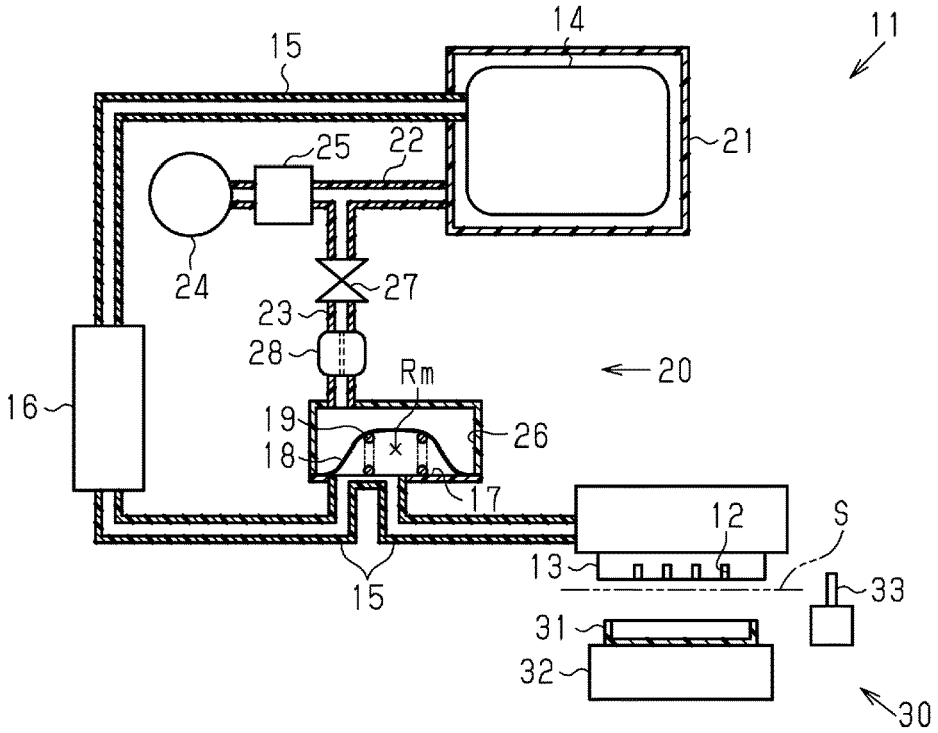
FIG. 1 is a cross sectional view which shows a first embodiment of a liquid ejecting apparatus.

As shown in FIG. 1, a liquid ejecting apparatus 11 according to the present embodiment includes a liquid ejecting head 13 having a plurality of nozzles 12 that eject liquid, a supply mechanism 20 that supplies liquid in a liquid supply source 14 to the liquid ejecting head 13, and a maintenance device 30.

The liquid supply source 14 is, for example, a liquid storage bag housed in a container 21. The liquid supply source 14 is formed by a flexible bag in which liquid is stored. A plurality of liquid supply sources 14 and containers 21 may be provided so that each corresponds to each of types of liquid (in this embodiment, colors of ink).

The supply mechanism 20 includes a supply flow path 15 that supplies liquid to the liquid ejecting head 13, a pressure adjustment mechanism 16 disposed at a midpoint in the supply flow path 15, a feeding path 22 that communicates with an inner space of the container 21, and a pressurizing mechanism 24 that applies pressure to the inner space of the container 21 via the feeding path 22.

The pressurizing mechanism 24 in this embodiment is a pump that pressurizes gas (for example, air), which is a fluid, and feeds out the pressurized gas. The feeding path 22 is provided with a decompression mechanism 25 composed of an air release valve that releases the pressurized gas to atmosphere.

As the gas is fed out via the feeding path 22 by driving of the pressurizing mechanism 24, the gas enters the container 21 to thereby increase the pressure inside the container 21. Then, a bag which forms the liquid supply source 14 is compressed, causing the liquid stored in the bag in the pressurized state to flow into the supply flow path 15.

The pressure adjustment mechanism 16 adjusts a flow rate of liquid supplied from the liquid supply source 14 so as to keep the pressure downstream the pressure adjustment mechanism 16 at a negative pressure within a predetermined range. For example, when the liquid ejecting head 13 ejects liquid onto a medium S, the pressure downstream the pressure adjustment mechanism 16 in the supply flow path 15 decreases due to consumption of liquid. Then, the pressure adjustment mechanism 16 allows the liquid of the consumed amount to flow from upstream to downstream sides. As described above, by virtue of the pressure adjustment mechanism 16 keeping the pressure of liquid inside the liquid ejecting head 13 at a negative pressure, leakage of liquid from the nozzles 12 can be prevented or the accuracy of liquid ejection can be improved.

On the upstream side of the pressure adjustment mechanism 16, the liquid pressurized by driving of the pressurizing mechanism 24 is supplied. Accordingly, as the pressure adjustment mechanism 16 permits a flow of liquid, the liquid is immediately supplied to the liquid ejecting head 13. The pressurizing mechanism 24 is driven as necessary in response to the pressure decrease in the supply flow path 15 so that the liquid in the supply flow path 15 on the upstream of the pressure adjustment mechanism 16 kept at a predetermined positive pressure.

A liquid storage chamber 17 that forms a region Rm which stores liquid is provided between the pressure adjustment mechanism 16 and the liquid ejecting head 13 in the supply flow path 15. The liquid storage chamber 17 includes a flexibly deformable displacement section 18 on a portion of the wall.

The supply mechanism 20 includes a pressure adjustment chamber 26 which is separated from the liquid storage chamber 17 by the displacement section 18, a bias member 19 that biases the displacement section 18 toward the pressure adjustment chamber 26, and a common flow path 23 that is branched from the feeding path 22 and communicates with the pressure adjustment chamber 26. Further, the supply mechanism 20 includes an on-off valve 27 that is provided in the common flow path 23 and a resistor section 28. The resistor section 28 is formed of, for example, a narrow flow path which is formed by reducing the flow path cross sectional area of a portion of the common flow path 23.

When the on-off valve 27 is opened while the feeding path 22 is pressurized, the pressurized gas flows into the pressure adjustment chamber 26 via the common flow path 23 to cause the displacement section 18 to be displaced in a direction to decrease the volume of the liquid storage chamber 17 against the biasing force of the bias member 19. Accordingly, the pressure inside the liquid storage chamber 17 increases. Here, the common flow path 23 serves as a pressurizing flow path that communicates with the pressurizing mechanism 24 and with the pressure adjustment chamber 26, and the region Rm that communicates with the supply flow path 15 is pressurized by driving of the pressurizing mechanism 24.

Further, when the air release valve that constitutes the decompression mechanism 25 is opened while the on-off valve 27 is open, the pressure adjustment chamber 26 is decompressed. Accordingly, the displacement section 18 is displaced in a direction to increase the volume of the liquid storage chamber 17 according to the biasing force of the bias member 19. Accordingly, the pressure inside the liquid storage chamber 17 decreases. Here, the common flow path 23 serves as a decompression flow path that communicates with the decompression mechanism 25 and with the pressure adjustment chamber 26, and the region Rm that pressurized by the supply flow path 24 is decompressed by the decompression mechanism 25.

Then, a configuration of the maintenance apparatus 30 and a maintenance operation performed by the maintenance apparatus 30 will be described in detail. The liquid ejecting apparatus 11 performs a maintenance operation such as flushing, capping, cleaning or wiping for prevention or elimination of ejection error caused by clogging of the nozzles 12 in the liquid ejecting head 13. The maintenance apparatus 30 includes a cap 31 that is configured to perform capping, a suction mechanism 32 connected to the cap 31, and a wiper 33 that wipes the liquid ejecting head 13.

Flushing is an operation to forcibly eject (discharge) liquid droplets from the nozzles 12 as an operation independent from a printing operation to thereby discharge foreign substance that causes ejection error, air bubble or degenerated liquid (for example, ink thickened due to evaporation of solvent component) as a waste liquid. The waste liquid discharged by flushing may be received in the cap 31 or in any other position.

The cap 31 and the liquid ejecting head 13 are configured to relatively move by a mechanism, which is not shown in the figure, between a capping position in which a closed space is provided by closing a space to which the nozzles 12 are open and an open position in which an open space is provided by opening a space to which the nozzles 12 are open. The cap 31 is positioned at the capping position to perform capping. Capping is performed to prevent evaporation of liquid in the nozzles 12 during the period in which liquid ejection is not performed so as to prevent occurrence of ejection error. Further, when waste liquid generated by flushing is received, the cap 31 is positioned at the open position.

When the suction mechanism 32 is actuated while the cap 31 is positioned at the capping position, negative pressure is generated in the closed space, which causes the liquid to be suctioned and discharged via the nozzles 12. This is called suction cleaning. Further, as the pressure adjustment mechanism 16 moves the pressurized liquid to the downstream side, the liquid pressurized by driving of the pressurizing mechanism 24 flows out from the nozzles 12. This is called pressurization cleaning. The suction cleaning and the pressurization cleaning are comprehensively called cleaning.

After the cleaning is performed, the wiper 33 wipes the liquid ejecting head 13 while moving relatively to the liquid ejecting head 13 in order to remove liquid attached on the liquid ejecting head 13. This is called wiping. In some cases, a foreign substance may be pushed into the nozzle 12 by the wiper 33 performing wiping. Accordingly, flushing is preferably performed after wiping.

Further, the pressurizing mechanism 24 may apply pressure on the inside of the liquid ejecting head 13 (the nozzle 12) during wiping to prevent the wiper 33 from pushing a foreign substance into the nozzle 12. In this case, while the pressure adjustment mechanism 16 regulates flow of the pressurized liquid, the on-off valve 27 is opened to allow the pressurized gas to flow into the pressure adjustment chamber 26 to thereby apply pressure on the region Rm in the supply flow path 15.

Here, in response to displacement of the displacement section 18 in the direction to decrease the volume of the liquid storage chamber 17, liquid flows toward the liquid ejecting head 13 and increases the pressure. Preferably, the pressure is increased to such an extent that the pressure which has been negative pressure increases to be higher than the barometric pressure and the liquid surface bulges without causing the liquid to flow out from the nozzles 12. Accordingly, even if the wiper 33 touches the liquid surface which bulges from the nozzles 12 during wiping and causes the liquid to flow out, the flow amount of liquid is small, that is, the amount which flows out from the liquid storage chamber 17. Thus, the wiping which is performed while pressurizing the inside of the nozzles 12 is called pressurization wiping.

Further, pressurization cleaning can be performed by increasing the degree of pressurization of the region Rm to be larger than that in pressurization wiping so that liquid flows out from the nozzles 12 in response to displacement of the displacement section 18 while the pressure adjustment mechanism 16 regulates flow of the pressurized liquid. The pressurization cleaning that discharges a small amount of liquid is effective, for example, for discharging an air bubble or thickened liquid near the nozzle 12.

In addition, while the pressure adjustment mechanism 16 regulates flow of the liquid with the on-off valve 27 opened, pressurization by driving of the pressurizing mechanism 24 and decompression by the decompression mechanism 25 may be alternately performed to vibrate the liquid surface in the nozzle 12. This maintenance operation by vibrating the liquid surface in the nozzle is called micro vibration. By virtue of micro vibration, an air bubble in the nozzle 12 moves toward the liquid surface and is discharged outside the nozzle 12. Accordingly, an air bubble which may cause ejection error can be removed without consuming liquid.

Next, effects of the liquid ejecting apparatus 11 having the above configuration will be described.

After the maintenance operation such as pressurization wiping or pressurization cleaning is performed by increasing the pressure inside the nozzles 12 which has been kept at negative pressure during ejection of liquid, the region Rm which has been pressurized by the pressurizing mechanism 24 is decompressed by the decompression mechanism 25 so as to return the pressure inside the nozzles 12 to negative pressure. For example, the air release valve as the decompression mechanism 25 is opened to allow the pressure adjustment chamber 26 to be released to the atmosphere via the common flow path 23.

Here, if the gas flows from the pressure adjustment chamber 26 to the common flow path 23 at a time, the pressure inside the region Rm instantaneously decreases due to the momentum of displacement of the displacement section 18 by a biasing force of the bias member 19. This may have a risk of entrainment of air bubbles into the nozzles 12.

In this embodiment, however, by virtue of the resistor section 28 disposed in the common flow path 23 between the decompression mechanism 25 and the pressure adjustment chamber 26, instantaneous flow of gas is prevented at the resistor section 28 having a reduced flow path cross sectional area even if the air release valve as the decompression mechanism 25 is opened. Accordingly, decompression caused by flowing out of gas can be prevented. As a result, the pressure in the pressurized region Rm gradually decreases to thereby prevent entrainment of air bubbles into the nozzles 12.

As described above, since the resistor section 28 is provided in the common flow path 23 that communicates with the pressure adjustment chamber 26 and allows a fluid (gas) to flow in and out so as to change the pressure in the region Rm, sudden decompression can be reduced with a simple configuration without need of detecting the pressure in the region Rm or the pressure adjustment chamber 26 or controlling the displacement amount of the displacement section 18.

According to the present embodiment, the following advantageous effects can be obtained.

(1) Sudden decompression of the pressurized region Rm can be reduced since the resistor section 28 interferes with decompression by the decompression mechanism 25.

(2) The region Rm formed by the liquid storage chamber 17 can be pressurized by pressurizing the pressure adjustment chamber 26 via the common flow path 23 (pressurization flow path) that communicates with the pressurizing mechanism 24 so as to displace the displacement section 18 toward the liquid storage chamber 17. Further, the pressurized liquid storage chamber 17 can be decompressed by decompressing the pressure adjustment chamber 26 via the common flow path 23 (decompression flow path) that communicates with the decompression mechanism 25 so as to displace the displacement section 18 toward the pressure adjustment chamber 26. Moreover, complexity in the apparatus and control can be reduced since sudden decompression can be reduced by the flow path structure by providing the resistor section 28 in the common flow path 23 (decompression flow path) that communicates with the pressure adjustment chamber 26.

(3) The configuration of the flow path can be simplified by providing the common flow path 23 which serves as a pressurization flow path and a decompression flow path, and providing the resistor section 28 in the common flow path 23.

(4) Since the pressurizing mechanism 24 is formed by a pump that pressurizes and pumps out a fluid, pressurization can be performed by feeding out a fluid and decompression can be performed by allowing the fluid to flow out from the space in which pressurization is performed.

(5) Since the pressurizing mechanism 24 is formed by a pump that pressurizes and pumps out a gas, pressurization can be performed by feeding out a gas and decompression can be performed by releasing the space in which pressurization is performed to the atmosphere by the air release valve which is the decompression mechanism 25 to thereby decompress the space to the atmospheric pressure.

(6) Decompression rate can be reduced with a simple configuration since the resistor section 28 is provided in the flow path that communicates with the decompression mechanism 25 so as to decrease the flow path cross sectional area of a portion of the flow path to be smaller than that of other portions to thereby interfere with decompression by the decompression mechanism 25.

Second Embodiment

Figure 2:
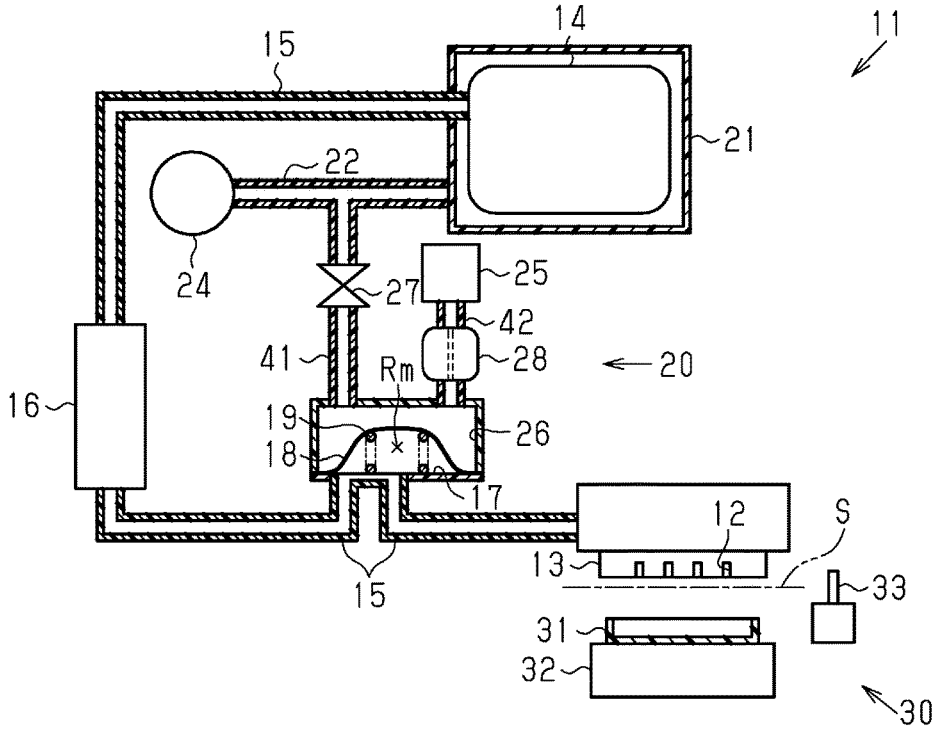
FIG. 2 is a cross sectional view which shows a second embodiment of the liquid ejecting apparatus.

With reference to FIG. 2, a second embodiment of the liquid ejecting apparatus 11 will be described.

In the second embodiment, the same references as those in the first embodiment refer to the same elements as those in the first embodiment, and the description of these elements is omitted. The following description will be made in focus on the points different from the first embodiment.

The supply mechanism 20 of the present embodiment differs from the first embodiment in that it does not include the common flow path 23 which serves as a pressurization flow path and a decompression flow path, and includes a pressurization flow path 41 that communicates with the pressurizing mechanism 24 via the feeding path 22 and communicates with the pressure adjustment chamber 26, and a decompression flow path 42 that communicates with the pressure adjustment chamber 26 independently from the pressurization flow path 41, and the resistor section 28 is provided in the decompression flow path 42.

Further, the on-off valve 27 of this embodiment is provided in the pressurization flow path 41, and the decompression mechanism 25 is provided in the decompression flow path 42. That is, the decompression flow path 42 communicates with the decompression mechanism 25 and the pressure adjustment chamber 26, and the resistor section 28 is disposed in the decompression flow path 42 between the decompression mechanism 25 and the pressure adjustment chamber 26.

In the liquid ejecting apparatus 11 of the present embodiment, as the on-off valve 27 is opened, the gas pressurized via the pressurization flow path 41 flows into the pressure adjustment chamber 26 to thereby pressurize the region Rm. Accordingly, since the pressure inside the nozzles 12 increases, maintenance operations which involve pressurization such as pressurization cleaning and pressurization wiping can be performed.

Further, subsequent to these maintenance operations which involve pressurization, the pressure adjustment chamber 26 is decompressed via the decompression flow path 42 by closing the on-off valve 27 and opening the air release valve which is the decompression mechanism 25. Accordingly, by virtue of the action of the resistor section 28 provided in the decompression flow path 42, instantaneous flow of gas from the pressure adjustment chamber 26 to the decompression flow path 42 is prevented, which allows the pressure in the pressurized region Rm to gradually decrease.

Since the decompression mechanism 25 and the resistor section 28 are provided in the decompression flow path 42 independently from the pressurization flow path 41, the decompression of the region Rm can be proceeded gradually, while pressurization of the region Rm can be proceeded rapidly. Accordingly, discharge effect of air bubble can be improved, for example, by urging liquid to instantaneously flow out from the nozzles 12 during pressurization cleaning or allowing the liquid surface in the nozzles 12 to substantially bulge during micro vibration. As a flow rate of liquid increases, the discharge effect of air bubble is improved.

According to the present embodiment, the following advantageous effects can be obtained in addition to the above advantageous effects described in (1), (4) to (6). (7) When the resistor section 28 is provided in the common flow path 23 that serves as a decompression flow path and a pressurization flow path, a pressurization rate during pressurization by the pressurizing mechanism 24 is lowered. However, since the resistor section 28 is provided in the decompression flow path 42 which does not serve as a pressurization flow path, the decompression rate can be slowed down without reducing the pressurization rate.

Further, according to the present embodiment, the following advantageous effects can be obtained as similar to the above (2). The region Rm formed by the liquid storage chamber 17 can be pressurized by pressurizing the pressure adjustment chamber 26 via the pressurization flow path 41 that communicates with the pressurizing mechanism 24 so as to displace the displacement section 18 toward the liquid storage chamber 17. Further, the pressurized liquid storage chamber 17 can be decompressed by decompressing the pressure adjustment chamber 26 via the decompression flow path 42 that communicates with the decompression mechanism 25 so as to displace the displacement section 18 toward the pressure adjustment chamber 26. Moreover, complexity in the apparatus and control can be reduced since sudden decompression can be reduced by the flow path structure by providing the resistor section 28 in the decompression flow path 42 that communicates with the pressure adjustment chamber 26.

Third Embodiment

Figure 3:
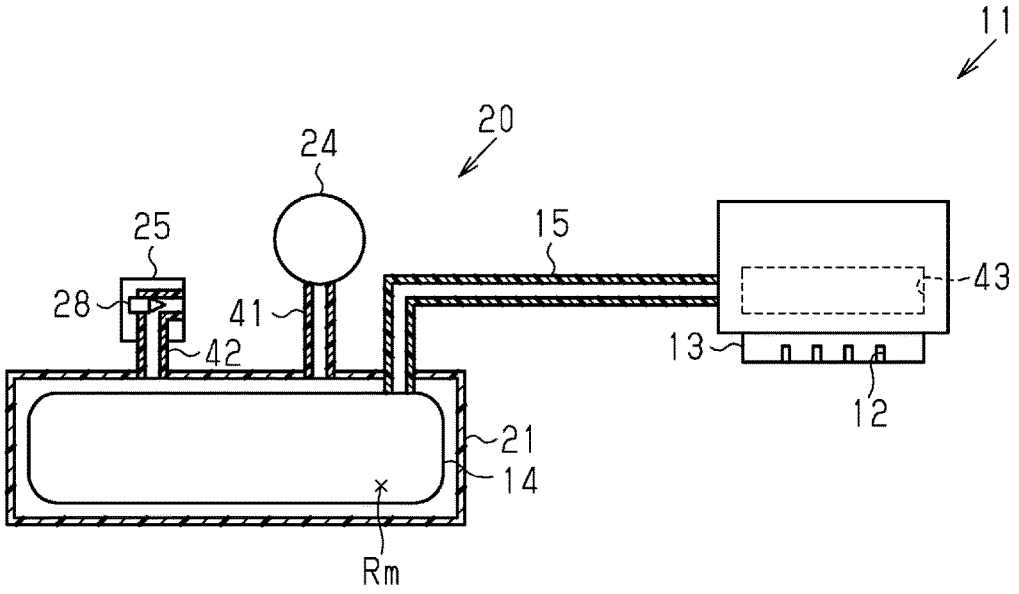
FIG. 3 is a cross sectional view which shows a third embodiment of the liquid ejecting apparatus.

With reference to FIG. 3, a third embodiment of the liquid ejecting apparatus 11 will be described.

In the third embodiment, the same references as those in the first and second embodiments refer to the same elements as those in these embodiments, and the description of these elements is omitted. The following description will be made in focus on the points different from the above embodiments. Further, in the following embodiment, illustration of the maintenance apparatus 30 is omitted.

The supply mechanism 20 of the present embodiment differs from the above embodiments in that the supply flow path 15 does not include the pressure adjustment mechanism 16 and the liquid storage chamber 17, and the sub tank 43 that temporarily stores liquid to be supplied to the nozzles 12 is provided upstream the liquid ejecting head 13.

In this embodiment, the inside of the bag that forms the liquid supply source 14 serves as the region Rm that communicates with the supply flow path 15. As the pressurizing mechanism 24 feeds the gas pressurized through the pressurization flow path 41 into the inner space of the container 21, the region Rm is pressurized. In this case, the bag that forms the liquid supply source 14 serves as a displacement section, and the container 21 serves as a pressure adjustment chamber.

The pressurized liquid is supplied to the liquid ejecting head 13, and is then used for maintenance operations which involve pressurization such as a liquid ejection and pressurization cleaning. Further, the sub tank 43 may be disposed at a position higher than the liquid supply source 14 in the gravitational direction to cause negative pressure inside the nozzles 12 during liquid ejection by a hydraulic head difference between the sub tank 43 and the liquid supply source 14.

The decompression mechanism 25 communicates with the inner space of the container 21 via the decompression flow path 42. The decompression mechanism 25 of this embodiment is an air release valve which is formed by a needle valve that includes a needle having a gradually tapered tip as the resistor section 28. In the needle valve, as the tip of the needle enters the decompression flow path 42, a flow path cross sectional area of the decompression flow path 42 decreases. Accordingly, when the region Rm is pressurized, the needle is inserted into the decompression flow path 42 to close the decompression flow path 42. When the pressurized region Rm is decompressed, the tip of the needle is left in the decompression flow path 42 to decrease the flow path cross sectional area so that gas is gradually discharged from the container 21 to interfere with decompression.

As described above, since the decompression mechanism 25 which includes the resistor section 28 is provided in the decompression flow path 42 which is different from the pressurization flow path 41, decompression of the region Rm can be gradually proceeded, while pressurization of the region Rm can be rapidly proceeded. Accordingly, discharge effect of air bubble can be improved, for example, by urging liquid to instantaneously flow out from the nozzles 12 during pressurization cleaning or allowing the liquid surface in the nozzles 12 to substantially bulge during micro vibration.

According to the present embodiment, the advantageous effect similar to the above second embodiment can be obtained. Further, since an air release valve composed of a needle valve that includes the resistor section 28 is provided as the decompression mechanism 25, the configuration can be simplified compared with the case where the decompression mechanism 25 and the resistor section 28 are separately provided. In addition, fine adjustment of the decompression rate can be made by adjusting the position of the needle.

Fourth Embodiment

Figure 4:
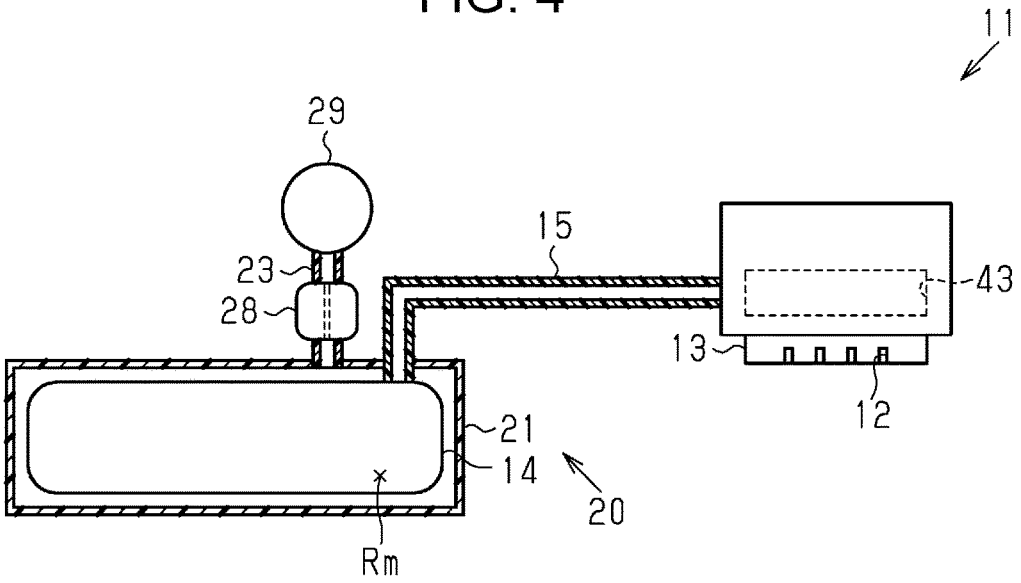
FIG. 4 is a cross sectional view which shows a fourth embodiment of the liquid ejecting apparatus.

With reference to FIG. 4, a fourth embodiment of the liquid ejecting apparatus 11 will be described. In this embodiment, the same references as those in the third embodiment refer to the same elements as those in the third embodiment, and the description of these elements is omitted. The following description will be made in focus on the points different from the third embodiment.

The liquid ejecting apparatus 11 of the present embodiment differs from the third embodiment in that the pressurizing mechanism and the decompression mechanism are formed of a single pump 29, and the pump 29 communicates with the liquid supply source 14 via the common flow path 23 which serves as a pressurization flow path and a decompression flow path, and the resistor section 28 is provided in the common flow path 23. That is, in this embodiment, a single pump 29 capable of driving in forward and reverse directions serves as a pressurizing mechanism when rotating in the forward direction to flow a fluid (gas or liquid) in one direction and a decompression mechanism when rotating in the reverse direction to flow a fluid in a direction opposite to the one direction.

In the liquid ejecting apparatus 11, the inside of the bag that forms the liquid supply source 14 serves as the region Rm that communicates with the supply flow path 15. When the region Rm is pressurized, the pump 29 rotates in the forward direction to feed a fluid pressurized through the common flow path 23 in one direction toward the inner space of the container 21.

Further, when the pressurized region Rm is decompressed, the pump 29 rotates in the reverse direction to flow a fluid pressurized through the common flow path 23 out of the inner space of the container 21. Since the resistor section 28 is provided in the common flow path 23 through which a fluid from the container 21 flows, a flow of fluid is interfered to thereby allow decompression of the region Rm to be gradually proceeded.

According to the present embodiment, the following advantageous effects can be obtained in addition to the above advantageous effects described in (1) to (4) and (6).

(8) The configuration to perform pressurization and decompression can be simplified since the pump 29 serves as a pressurizing mechanism and a decompression mechanism.

Fifth Embodiment

Figure 5:
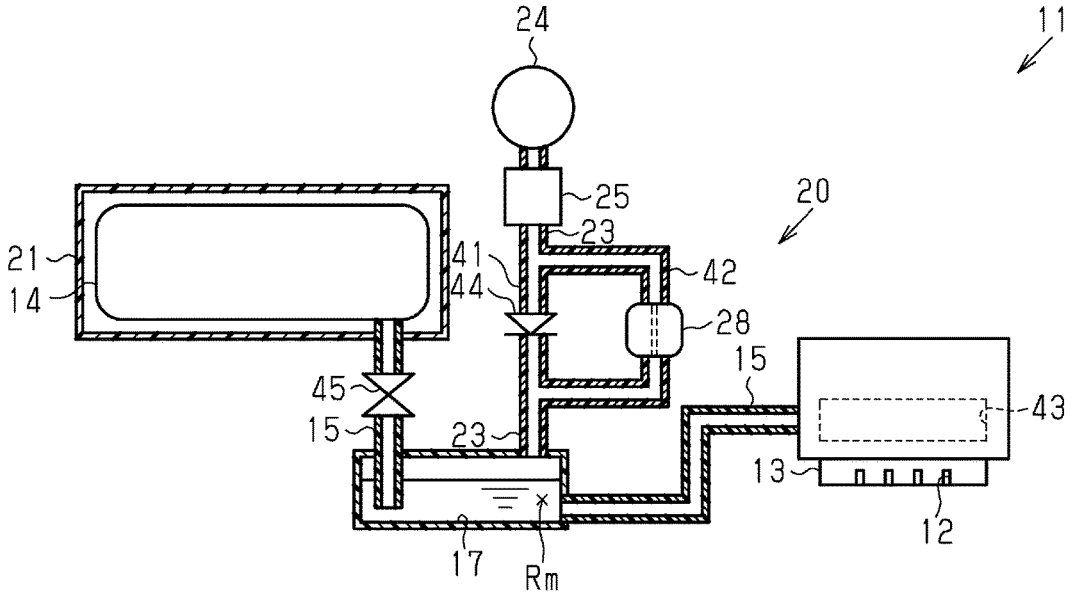
FIG. 5 is a cross sectional view which shows a fifth embodiment of the liquid ejecting apparatus.

With reference to FIG. 5, a fifth embodiment of the liquid ejecting apparatus 11 will be described. In this embodiment, the same references as those in the first and second embodiments refer to the same elements as those in these embodiments, and the description of these elements is omitted. The following description will be made in focus on the points different from the above embodiments.

In the supply mechanism 20 of the present embodiment, an on-off valve 45 instead of the pressure adjustment mechanism 16 is provided at a midpoint in the supply flow path 15, and the sub tank 43 that temporarily stores liquid to be supplied to the nozzles 12 is provided upstream the liquid ejecting head 13. Further, in this embodiment, the liquid storage chamber 17 that does not includes the displacement section 18 is disposed in the supply flow path 15 between the liquid supply source 14 and the sub tank 43, and the common flow path 23 which serves as a pressurization flow path and a decompression flow path communicate with the top side of the liquid storage chamber 17.

In the configuration in which the liquid supply source 14 is disposed at a position higher than the liquid storage chamber 17 in the gravitational direction, and the air release valve, which is the decompression mechanism 25, is opened to release the liquid storage chamber 17 to the atmosphere, liquid flows by natural down flow from the liquid supply source 14 to the liquid storage chamber 17 when the on-off valve 45 is opened. Further, liquid stops flowing from the liquid supply source 14 to the liquid storage chamber 17 when the on-off valve 45 is closed.

Further, in the configuration in which the sub tank 43 is disposed at a position higher than the liquid storage chamber 17 in the gravitational direction, negative pressure can be generated inside the nozzles 12 by a hydraulic head difference between the liquid storage chamber 17 which is released to the atmosphere and the sub tank 43 when the on-off valve 45 is closed.

The pressurizing mechanism 24 and the decompression mechanism 25 are provided in the common flow path 23. When the pressurizing mechanism 24 is a pump that feeds gas, the decompression mechanism 25 may be the air release valve that releases the common flow path 23 to the atmosphere. Alternatively, release to the atmosphere can be made in the pump or on the upstream side of the pump. This embodiment adopts the configuration in which the decompression mechanism 25 is disposed in the common flow path 23 between the pressurizing mechanism 24 and the liquid storage chamber 17.

The common flow path 23 is bifurcated at a middle portion, which is between the decompression mechanism 25 and the liquid storage chamber 17. One flow path is provided with a one-way valve 44 and serves as a pressurization flow path 41, while the other flow path is provided with the resistor section 28 and serves as a decompression flow path 42. When the location where the pressurizing mechanism 24 is disposed is defined as an upstream side in the pressurization flow path 41, the one-way valve 44 disposed in the pressurization flow path 41 which is not the common flow path 23, permits a fluid flowing from the pressurizing mechanism 24 to the downstream side and prevents a fluid flowing from the downstream side toward the pressurizing mechanism 24.

That is, when the pressurizing mechanism 24 feeds gas while the decompression mechanism 25, which is an air release valve, is closed, the pressurized gas flows into the liquid storage chamber 17 mainly via the pressurization flow path 41 since the resistor section 28 is disposed in the decompression flow path 42 which is not the common flow path 23 to interfere with a flow of gas. Accordingly, liquid in the liquid storage chamber 17 is pressurized by the gas flowing into the liquid storage chamber 17, and is supplied to the liquid ejecting head 13 via the supply flow path 15 and the sub tank 43. Thus, in this embodiment, the liquid storage chamber 17 forms the region Rm that communicates with the supply flow path 15.

After the maintenance operation which involves pressurization such as pressurization cleaning or pressurization wiping is performed in the liquid ejecting head 13, when the decompression mechanism 25 which is an air release valve is opened, gas flows out from the liquid storage chamber 17 into the common flow path 23 as gas flows out from the common flow path 23 to the atmosphere. In so doing, a flow of gas is reduced since the one-way valve 44 is provided in the pressurization flow path 41. Accordingly, the gas which flows out from the liquid storage chamber 17 mainly passes through the decompression flow path 42. As a result, a flow of gas is interfered with the resistor section 28 provided in the decompression flow path 42, and decompression of the region Rm gradually proceeds.

As described above, a flow path configuration can be simplified by connecting the pressurizing mechanism 24 and the liquid storage chamber 17 via the common flow path 23. Further, a portion of the common flow path 23 is branched so that one branch flow path serves as the pressurization flow path 41 by providing the one-way valve 44 in the one flow path, while the other branch flow path serves as the decompression flow path 42 by providing the resistor section 28 in the other flow path.

Thus, decompression of the region Rm can be gradually proceeded, while pressurization of the region Rm can be rapidly proceeded. Accordingly, discharge effect of air bubble can be improved, for example, by urging liquid to instantaneously flow out from the nozzles 12 during pressurization cleaning or allowing the liquid surface in the nozzles 12 to substantially bulge during micro vibration.

Moreover, in order to rapidly perform pressurization of liquid, a plurality of pressurization flow paths 41 branched from the common flow path 23 may be provided. In this case, the one-way valve 44 may be provided for each of the pressurization flow paths 41. According to the present embodiment, the following advantageous effects can be obtained in addition to the above advantageous effects described in (1), (4) to (7).

(9) Complexity in the apparatus and control can be reduced since sudden decompression can be reduced by the flow path structure by providing the resistor section 28 in the decompression flow path 42 that communicates with the liquid storage chamber 17.

(10) Since the one-way valve 44 is provided in the pressurization flow path 41 which is not the common flow path 23, a flow of fluid flowing from the common flow path 23 to the pressurization flow path 41 during decompression is reduced so as to flow the fluid into the decompression flow path 42. Accordingly, the decompression rate can be slowed down by effectively operating the resistor section 28.

Sixth Embodiment

Figure 6:
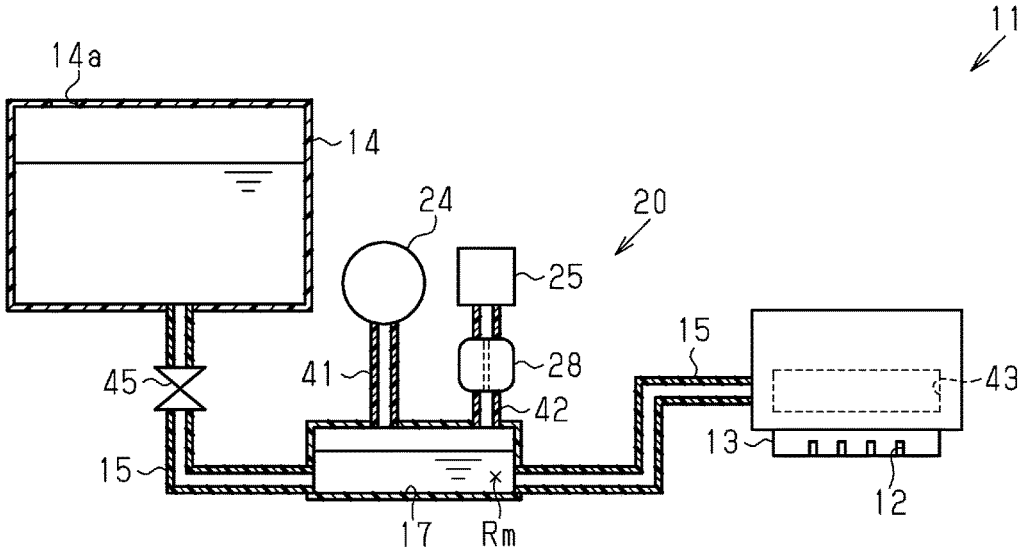
FIG. 6 is a cross sectional view which shows a sixth embodiment of the liquid ejecting apparatus.

With reference to FIG. 6, a sixth embodiment of the liquid ejecting apparatus 11 will be described.

In this embodiment, the same references as those in the fifth embodiment refer to the same elements as those in the fifth embodiment, and the description of these elements is omitted. The following description will be made in focus on the points different from the fifth embodiment.

In the liquid ejecting apparatus 11 of the present embodiment, the liquid supply source 14 is a tank which does not include a displacement section, and an open-to-atmosphere hole 14*a* is disposed on a top of the tank. The pressurization flow path 41 that communicates with the pressurizing mechanism 24 and the decompression flow path 42 that communicates with the decompression mechanism 25 individually communicate with the top side of the liquid storage chamber 17, which is located in the supply flow path 15 between the liquid supply source 14 and the sub tank 43. That is, the liquid ejecting apparatus 11 includes the liquid storage chamber 17 that forms the region Rm, the pressurization flow path 41 which communicates with the pressurizing mechanism 24 and the liquid storage chamber 17, and the decompression flow path 42 which communicates with the decompression mechanism 25 and the liquid storage chamber 17. The resistor section 28 is provided in the decompression flow path 42.

In the present embodiment, as the pressurizing mechanism 24 feeds gas into the liquid storage chamber 17 via the pressurization flow path 41, liquid in the liquid storage chamber 17 is pressurized and is supplied to the liquid ejecting head 13 via the supply flow path 15 and the sub tank 43.

After the maintenance operation which involves pressurization such as pressurization cleaning or pressurization wiping is performed in the liquid ejecting head 13, when the decompression mechanism 25 which is an air release valve is opened, gas flows out from the liquid storage chamber 17 into the decompression flow path 42 as gas flows out from the decompression flow path 42 to the atmosphere. Since the resistor section 28 is provided in the decompression flow path 42, a flow of gas is interfered. Accordingly, decompression of the region Rm gradually proceeds.

According to the present embodiment, the advantageous effects of the above (1), (4) to (7) and (9) can be obtained.

Seventh Embodiment

Figure 7:
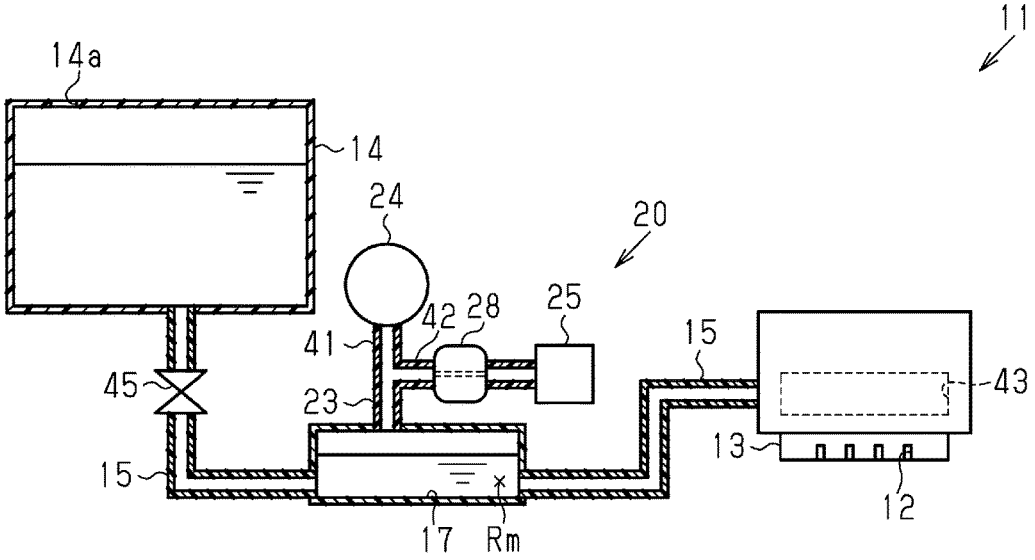
FIG. 7 is a cross sectional view which shows a seventh embodiment of the liquid ejecting apparatus.

With reference to FIG. 7, a seventh embodiment of the liquid ejecting apparatus 11 will be described.

In this embodiment, the same references as those in the sixth embodiment refer to the same elements as those in the sixth embodiment, and the description of these elements is omitted. The following description will be made in focus on the points different from the sixth embodiment.

The present embodiment differs from the sixth embodiment in that one end of the common flow path 23 which serves as a pressurization flow path and a decompression flow path communicates with the top side of the liquid storage chamber 17, and the other end of the common flow path 23 is branched into the pressurization flow path 41 and the decompression flow path 42. In this embodiment, when a branch point of the common flow path 23 is defined as a downstream end, the pressurizing mechanism 24 is provided on the upstream end of the pressurization flow path 41, and the decompression mechanism 25 is provided on the upstream end of the decompression flow path 42. Further, the resistor section 28 is provided in the decompression flow path 42 which is not the common flow path 23.

In the present embodiment, when the pressurizing mechanism 24 feeds out gas via the pressurization flow path 41, the gas flows into the liquid storage chamber 17 via the common flow path 23 to thereby pressurize liquid in the liquid storage chamber 17. Further, when the decompression mechanism 25 which is an air release valve is opened, gas flows out from the liquid storage chamber 17 into the common flow path 23 as gas flows out from the decompression flow path 42 to the atmosphere. Since the resistor section 28 is provided in the decompression flow path 42, a flow of gas is interfered. Accordingly, decompression of the region Rm gradually proceeds.

Thus, decompression of the region Rm can be gradually proceeded, while pressurization of the region Rm can be rapidly proceeded. Accordingly, discharge effect of air bubble can be improved, for example, by urging liquid to instantaneously flow out from the nozzles 12 during pressurization cleaning or allowing the liquid surface in the nozzles 12 to substantially bulge during micro vibration.

According to the present embodiment, the advantageous effect similar to the above sixth embodiment can be obtained.

The above embodiments may be changed as described in the following modified examples. Further, the above embodiments and the following modified examples may be combined as appropriate.

- The resistor section 28 may increase a flow path resistance so as to interfere with decompression by providing a flow path having a reduced flow path cross sectional area, a mesh filter or a porous material placed in the flow path, or a meandering flow path which curves repeatedly to increase a flow path length.
- The pressurizing mechanism 24 is not limited to that feeds a fluid such as gas to apply pressure on liquid, but may also be configured to apply pressure by pressing the displacement section 18 or a bag that forms the liquid supply source 14 by moving a pressing member such as a spring in one direction (pressurization direction). In this case, decompression may be performed by releasing a pressing force when the pressing member is moved in a decompression direction which is a direction opposite to the pressurization direction. When such a configuration is adopted, a speed of the pressing member moving in the pressurization direction may be increased compared with a speed of the pressing member subsequently moving in the decompression direction so that pressurization is quickly performed, while decompression is slowly performed.

Whether the bag having flexibility (displacement section) or the tank which does not include the displacement section is used for the liquid supply source 14 of the above embodiment may be changed as appropriate.

In the above embodiments, whether the pressure adjustment mechanism 16 is used like the first and second embodiment or a hydraulic head difference is used like the third to seventh embodiment for the mechanism to cause negative pressure in the nozzles 12 during liquid ejection can be changed as appropriate.

The air release valve (decompression mechanism 25) composed of a needle valve in the third embodiment may be adopted in other embodiments, or the decompression mechanism 25 in the third embodiment may be replaced with an air release valve having an unadjustable opening and closing degree.

The maintenance apparatus 30 may be replaced with a liquid receiver that can receive liquid discharged from the nozzles 12.

The medium S is not limited to a paper sheet, and may be a plastic film or a thin plate, or alternatively, a cloth used in a fabric printing apparatus.

Liquid ejected by a liquid ejecting unit is not limited to ink, and may be, for example, a liquid material which is made by dispersing or mixing a particle of a functional material in liquid. For example, recording can be performed by ejecting a liquid material which includes dispersed or mixed material such as electrode material or color material (pixel material) used for production of liquid crystal displays, EL (electroluminescence) displays and surface emission displays.

The entire disclosure of Japanese Patent Application No. 2016-042170, filed Mar. 4, 2016 is expressly incorporated by reference herein.

What is claimed is:

1. A liquid ejecting apparatus comprising:

a liquid ejecting head having a nozzle that ejects liquid;

a supply flow path that supplies the liquid to the liquid ejecting head;

a pressurizing mechanism that pressurizes a region which communicates with the supply flow path;

a decompression mechanism that decompresses the region pressurized by the pressurizing mechanism, wherein the decompression mechanism comprises an air valve; and a resistor section that interferes with decompression by the decompression mechanism.

2. The liquid ejecting apparatus according to claim 1, further comprising:

a liquid storage chamber that forms the region;

a pressurization flow path that communicates with the pressurizing mechanism and the liquid storage chamber; and a decompression flow path that communicates with the decompression mechanism and the liquid storage chamber, wherein the resistor section is provided in the decompression flow path.

3. The liquid ejecting apparatus according to claim 2, further comprising:

a common flow path that serves as the pressurization flow path and the decompression flow path, wherein the resistor section is provided in the decompression flow path which is not the common flow path.

4. The liquid ejecting apparatus according to claim 3, further comprising:

a one-way valve provided in the pressurization flow path which is not the common flow path, wherein, when a location where the pressurizing mechanism is located is defined as an upstream side in the pressurization flow path, the one-way valve permits a fluid flowing from the pressurizing mechanism to a downstream side and prevents a fluid flowing from a downstream side toward the pressurizing mechanism.

5. The liquid ejecting apparatus according to claim 2, further comprising:

a common flow path that serves as the pressurization flow path and the decompression flow path, wherein the resistor section is provided in the common flow path.

6. The liquid ejecting apparatus according to claim 2, wherein the resistor section is provided in a flow path that communicates with the decompression mechanism so as to decrease a flow path cross sectional area of a portion of the flow path to be smaller than a cross sectional area of other portions to thereby interfere with decompression by the decompression mechanism.

7. The liquid ejecting apparatus according to claim 1, further comprising:

a liquid storage chamber having a flexibly deformable displacement section on a portion of a wall and forms the region;

a pressure adjustment chamber that is separated from the liquid storage chamber via the displacement section;

a pressurization flow path that communicates with the pressurizing mechanism and the pressure adjustment chamber; and a decompression flow path that communicates with the decompression mechanism and the pressure adjustment chamber, wherein the resistor section is provided in the decompression flow path.

8. The liquid ejecting apparatus according to claim 7, further comprising:

a common flow path that serves as the pressurization flow path and the decompression flow path, wherein the resistor section is provided in the decompression flow path which is not the common flow path.

9. The liquid ejecting apparatus according to claim 8, further comprising:

a one-way valve provided in the pressurization flow path which is not the common flow path, wherein when a location where the pressurizing mechanism is located is defined as an upstream side in the pressurization flow path, the one-way valve permits a fluid flowing from the pressurizing mechanism to a downstream side and prevents a fluid flowing from a downstream side toward the pressurizing mechanism.

10. The liquid ejecting apparatus according to claim 7, further comprising:

a common flow path that serves as the pressurization flow path and the decompression flow path, wherein the resistor section is provided in the common flow path.

11. The liquid ejecting apparatus according to claim 7, wherein the resistor section is provided in a flow path that communicates with the decompression mechanism so as to decrease a flow path cross sectional area of a portion of the flow path to be smaller than a cross sectional area of other portions to thereby interfere with decompression by the decompression mechanism.

12. The liquid ejecting apparatus according to claim 1, wherein the pressurizing mechanism is a pump that pressurizes a fluid and feeds out the pressurized fluid.

13. The liquid ejecting apparatus according to claim 1, wherein the pressurizing mechanism and the decompression mechanism are composed of a single pump, serve as the pressurizing mechanism when the pump flows a fluid in one direction, and serve as the decompression mechanism when the pump flows a fluid in a direction opposite to the one direction.

14. The liquid ejecting apparatus according to claim 1, wherein the pressurizing mechanism is a pump that pressurizes gas and feeds out the pressurized gas, and the decompression mechanism is composed of an air release valve.

15. The liquid ejecting apparatus according to claim 1, wherein the resistor section is provided in a flow path that communicates with the decompression mechanism so as to decrease a flow path cross sectional area of a portion of the flow path to be smaller than a cross sectional area of other portions to thereby interfere with decompression by the decompression mechanism.

16. The liquid ejecting apparatus according to claim 1, further comprising:

a liquid storage chamber that forms the region;

a pressurization flow path that communicates with the pressurizing mechanism and the liquid storage chamber; and a decompression flow path that communicates with the decompression mechanism and the liquid storage chamber, wherein the pressurization flow path and the decompression flow path include a common portion.

17. A liquid ejecting apparatus comprising:

a liquid ejecting head having a nozzle that ejects liquid;

a supply flow path that supplies the liquid to the liquid ejecting head;

a pressurizing mechanism that pressurizes a region which communicates with the supply flow path;

a decompression mechanism that decompresses the region pressurized by the pressurizing mechanism;

a resistor section that interferes with decompression by the decompression mechanism;

a liquid storage chamber that forms the region;

a pressurization flow path that communicates with the pressurizing mechanism and the liquid-storage chamber;

a decompression flow path that communicates with the decompression mechanism and the liquid storage chamber; and a common flow path that serves as the pressurization flow path and the decompression flow path, and wherein the resistor section is provided in the decompression flow path which is not the common flow path.

18. The liquid ejecting apparatus according to claim 17, further comprising:

a one-way valve provided in the pressurization flow path which is not the common flow path, wherein, when a location where the pressurizing mechanism is located is defined as an upstream side in the pressurization flow path, the one-way valve permits a fluid flowing from the pressurizing mechanism to a downstream side and prevents a fluid flowing from a downstream side toward the pressurizing mechanism.

19. The liquid ejecting apparatus according to claim 17, wherein the pressurizing mechanism is a pump that pressurizes a fluid and feeds out the pressurized fluid.

20. The liquid ejecting apparatus according to claim 17, wherein the resistor section is provided in a flow path that communicates with the decompression mechanism so as to decrease a flow path cross sectional area of a portion of the flow path to be smaller than a cross sectional area of other portions to thereby interfere with decompression by the decompression mechanism.

* * * * *